US006109516A

United States Patent [19]

Laghi et al.

[11] Patent Number: 6,109,516

[45] Date of Patent: Aug. 29, 2000

[54] RIGID PACKET WITH HINGED LID FOR ELONGATED ELEMENTS

[75] Inventors: Alberto Laghi, Ravenna; Chiara Colò, Fiumalbo; Fiorenzo Draghetti, Medicina, all of Italy

[73] Assignee: G.D. S.p.A., Bologna, Italy

[21] Appl. No.: 09/436,354

[22] Filed: Nov. 9, 1999

[30] Foreign Application Priority Data

Nov. 12, 1998 [IT] Italy ..... BO98A0623

[51] Int. Cl.[7] ..... B65D 85/10

[52] U.S. Cl. ..... 229/146; 206/268; 229/155

[58] Field of Search ..... 206/265, 268, 206/271, 273; 229/146, 155, 160.1

[56] References Cited

U.S. PATENT DOCUMENTS

| | | | |
|---|---|---|---|
| Re. 29,887 | 1/1979 | Fox et al. | 229/160.1 |
| 3,708,108 | 1/1973 | Rosenburg, Jr. . | |
| 4,303,191 | 12/1981 | Foster et al. | 229/160.1 |
| 4,948,038 | 8/1990 | Moeller | 229/146 |
| 5,314,114 | 5/1994 | Stone | 229/160.1 |
| 5,366,077 | 11/1994 | Pham | 206/268 |
| 5,634,588 | 6/1997 | Jorgensen-Beck et al. | 206/273 |
| 5,806,671 | 9/1998 | Focke et al. . | |
| 5,896,984 | 4/1999 | Focke et al. | 206/268 |

FOREIGN PATENT DOCUMENTS

| | | |
|---|---|---|
| 0801010 | 10/1997 | European Pat. Off. . |
| 19648240 | 5/1998 | Germany . |

*Primary Examiner*—Jim Foster
*Attorney, Agent, or Firm*—Pillsbury Madison & Sutro LLP

[57] ABSTRACT

A rigid cigarette packet appears as a cupped container with one open end, surmounted by a hinged lid, and is stiffened by a frame anchored firmly to the inside of the container. The frame exhibits a front portion and two lateral portions projecting from the open end, of which the lateral portions are fashioned with respective flaps bent double and presenting a Vee profile when viewed in cross section; when the lid is lowered to cover the open end of the container, the two flaps engage in a snap fit with corresponding flaps incorporated into the flank faces of the lid, ensuring a stable closure.

6 Claims, 3 Drawing Sheets

RIGID PACKET WITH HINGED LID FOR ELONGATED ELEMENTS

BACKGROUND OF THE INVENTION

The present invention relates to a rigid packet with hinged lid for elongated elements.

In particular, the present invention relates to a packet with a hinged lid for cigarettes, of the type comprising a cupped container or hollow body presenting a front face and a rear face, mutually opposed and parallel, two mutually parallel flank faces perpendicular to the front and rear faces, a bottom end face orthogonal to the front, rear and flank faces, and one open end; also a lid, likewise of cupped embodiment, hinged to the container along a top edge of the rear face and capable of movement relative to the container away from and toward a position in which it functions as a closure for the open end, the lid in turn presenting a front face and a rear face mutually opposed and parallel, two mutually parallel flank faces perpendicular to the front and rear faces, and an end face orthogonal to the front, rear and flank faces. The packet further comprises a frame of "U" outline, inserted partly into and breasted with the front and flank faces of the container, which presents a central portion and two lateral portions projecting upward from the top edges of the front and flank faces of the container in such a way as to engage the lid in part.

Generally speaking, the principal function of the frame in rigid packets of the type described above is to interact with the lid in such a way as will limit the likelihood of its opening accidentally when in the closed position.

Owing to the springy nature of the paper material from which the frame is fashioned, however, the resulting interference between the frame and the lid is often not sufficient to maintain the lid correctly in the closed position.

One expedient aimed at overcoming the drawback in question is disclosed in reference WO 98/18683 A1, which relates to a rigid packet of the type with a hinged lid wherein the central projecting portion of the frame is embodied with a flap, bent outwards and down over the selfsame portion, in such a way as to snap into engagement with the corresponding edge of an inner reinforcing fold afforded by the front face of the lid and thus ensure a complete and stable retention of the lid when in the closed position.

Conversely the rigid packet in question is rather less than satisfactory in terms of appearance due to the presence of the folded flap, which occupies a frontal position, associated with the central portion of the frame and projecting away from the container, and is particularly noticeable on the front face of the packet when the lid is open.

The object of the invention is to provide a rigid packet with a hinged lid that will be unaffected by the drawback described above.

SUMMARY OF THE INVENTION

The stated object is realized according to the present invention in a rigid packet with a hinged lid for elongated elements, comprising a cupped container that presents a front face and a rear face mutually opposed and parallel, two parallel flank faces perpendicular to the front and rear faces, an end face orthogonal to the front, rear and flank faces, and one open end; a lid hinged to the container and capable thus of movement relative to the container away from and toward a position in which it functions as a closure for the open end, presenting a front face and a rear face mutually opposed and parallel, two parallel flank faces perpendicular to the front and rear faces, and an end face orthogonal to the front, rear and flank faces; a reinforcing frame of "U" outline inserted partly into the container and breasted in contact with the front face and two flank faces thereof, presenting a front portion and two lateral portions projecting from the open end; also mutual retaining means afforded by the frame and the lid, such as will cause the lid to snap shut.

To advantage, the mutual retaining means comprise two flaps bent substantially double to assume a Vee section, each associated with a relative projecting lateral portion of the reinforcing frame, and two flaps located internally of the lid each associated with a relative flank face and positioned such that each bent flap engages a corresponding flap of the lid when in the closed position.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
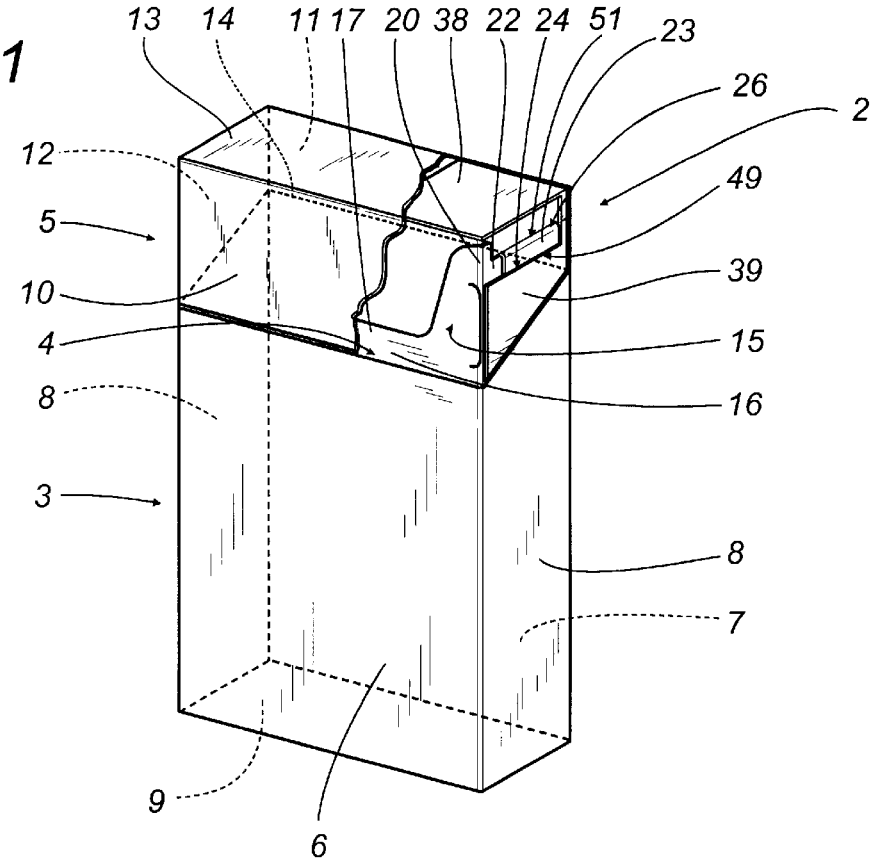
FIG. 1 illustrates a preferred embodiment of the packet according to the present invention, seen in perspective with certain parts omitted for clarity.
Figure 2:
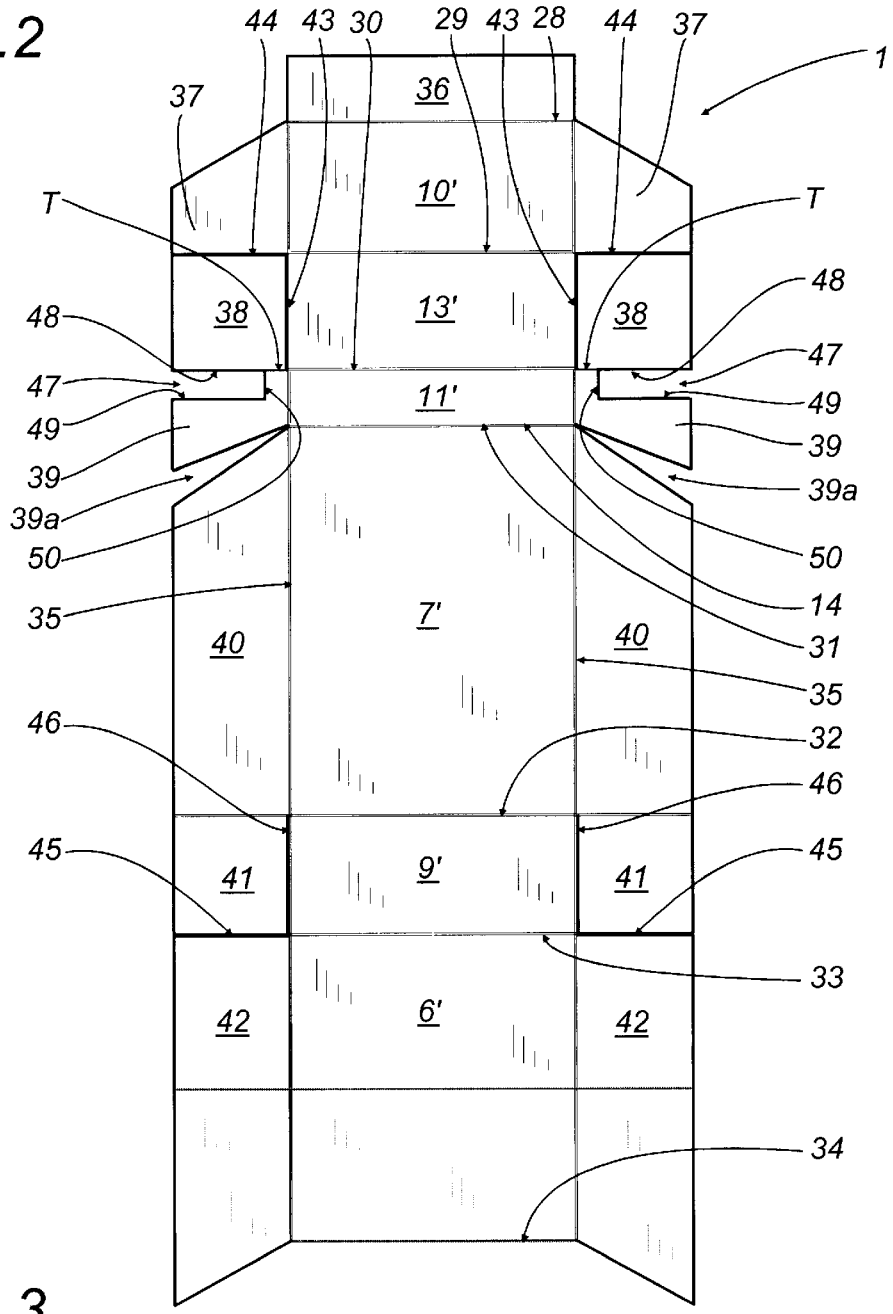
FIG. 2 is the plan view of a diecut blank from which the packet of FIG. 1 might be fashioned.

Referring to FIG. 2 of the drawings, 1 denotes a flat and substantially rectangular diecut blank from which a rigid packet 2 as illustrated in FIG. 1 is fashioned by executing a succession of folds, utilizing a conventional bending method.

The packet 2 shown in FIG. 1 serves to accommodate a group of cigarettes (not indicated), and will be seen to comprise a container 3 of cupped embodiment affording an open top end 4, also a lid 5, likewise of cupped embodiment, hinged to the container 3 and rotatable thus between open and closed positions in which the open top end 4 is exposed and concealed, respectively.

The cupped container 3 presents a front face 6 and a rear face 7, mutually opposed and parallel, also two mutually opposed flank faces 8 disposed parallel one with another, perpendicular to the front and rear faces 6 and 7, and an end face 9 orthogonal to the remaining four faces 6, 7 and 8.

In like manner the lid 5 presents a front face 10 and a rear face 11, mutually opposed and parallel, two flank faces 12 parallel one with another and perpendicular to the front and rear faces 10 and 11, and an end face 13 orthogonal to the remaining faces 10, 11 and 12. In particular, a bottom edge afforded by the rear face 11 of the lid and a top edge afforded by the rear face 7 of the container are joined permanently along a previously formed crease, creating a hinge 14 about which the lid 5 is rotatable between the open and closed positions.

The packet 2 also comprises an inner reinforcing frame 15 of "U" outline projecting from the open top end 4 of the container.

Figure 3:
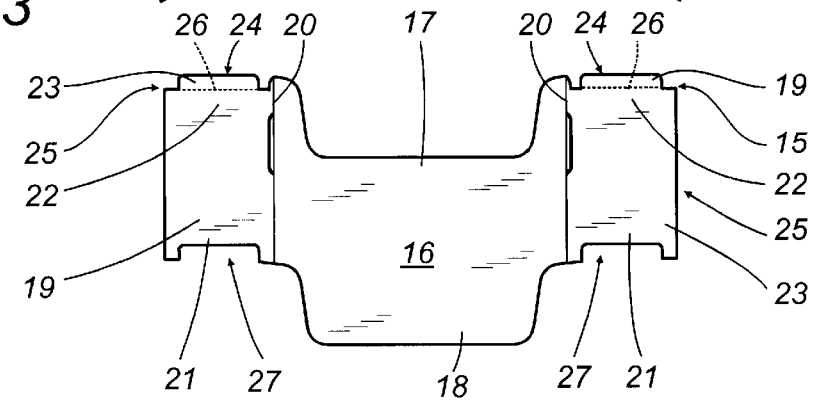
FIG. 3 is the plan view of an inner reinforcing frame forming part of the packet in FIG. 1.

Observing FIGS. 1 and 3, the frame 15 will be seen to comprise a central panel 16 exhibiting an upper portion 17 that projects beyond the front face 6 of the container, and a lower portion 18 fixed to an internal surface of the selfsame front face 6. The frame 15 further comprises two lateral panels 19 separated geometrically from the central panel 16 by two crease lines 20, exhibiting respective lower portions 21 fixed each to an internal surface of the corresponding flank face 8 of the container, and respective upper portions 22 projecting from the selfsame flank faces 8.

The upper portions 22 of the lateral panels 19 afforded by the inner frame 15 are fashioned with relative flaps 23 (see FIG. 1), each exhibiting a free edge 24 and coinciding with an extremity 25 of the relative portion 22 that is bent double along a previously embossed crease line 26 and effectively flattened against the panel 19 (in a conventional manner not illustrated) to assume a Vee section.

The lower portion 21 of each lateral panel 19 is fashioned with a recess 27 of which the dimensions correspond exactly to those of one flap 23.

As discernible in FIG. 2, the blank 1 is prepared with a plurality of longitudinal and transverse crease lines establishing the different faces and folds of the packet 2.

To simplify the passage of the specification that follows, the panels of the blank 1 and the faces of the packet 2 are denoted by numbers common to both, and primed in the case of the blank.

Observing FIG. 2, it will be seen that the diecut blank 1 exhibits a plurality of transverse crease lines 28 . . . 33 and two longitudinal crease lines 35 which combine to divide up the cut area into panels corresponding to the various faces and folds of the container 3 and the lid 5.

The transverse crease lines 28 . . . 33 serve to define a succession of elements compassed between the two longitudinal crease lines 35: an end flap 36, and a first end panel 10' against which the flap 36, bent double by rotation through 180° around the crease line denoted 28, is flattened to afford an internal stiffening element; a first intermediate panel 13'; a second intermediate panel 11' shallower than the first intermediate panel 13'; a central panel 7' joined to the second intermediate panel 11' along a crease line 31 providing the hinge 14; a third intermediate panel 9'; and a second end panel 6' terminating in a free edge 34 that coincides with the open end 4 of the packet.

Still observing FIG. 2, the panels 10', 13', 11', 7', 9' and 6' are divided by the two longitudinal crease lines 35 from corresponding pairs of flaps denoted 37, 38, 39, 40, 41 and 42 respectively, one on either side, of which the flaps 38 adjoining the first intermediate panel 13' are separated from the panel 13' and from the adjoining flaps denoted 37 by respective cuts 43 and 44 coinciding with the longitudinal crease lines 35 and with the relative transverse crease line 29, while associated with the adjoining flaps denoted 39 along a line T of predetermined length coinciding with the relative transverse crease line 30. In like manner, the two flaps 41 adjoining the third intermediate panel 9' are associated with one pair of adjoining flaps 40 along the relative transverse crease line 32, and separated from the panel 9' and from the remaining pair of flaps 42 by cuts 45 and 46 that coincide respectively with the longitudinal crease lines 35 and the relative transverse crease line 33.

Again in FIG. 2, each of the flaps 39 associated with the second intermediate panel 11' along the relative longitudinal crease line 35 is separated from the one adjoining flap 40 by a substantially triangular notch 39*a*, and from the flap 38 opposite by a substantially rectangular notch 47 with one open end outermost, compassed between a free edge of the one flap 38, coinciding with the transverse crease line 30, and a free edge 49 of the flap 39 itself; the two free edges 48 and 49 in question extend mutually parallel and are interconnected by an edge 50 disposed parallel to the longitudinal crease line 35.

As discernible from FIG. 1, each notched flap 39 affords an inside fold 51 serving to stiffen the corresponding flank face 12 of the lid 5, of which the top edge 49 is distanced from the corner at which the flank face 12 meets the end face 13, and positioned in such a way as to snap into engagement with the edge 24 offered by the relative flap 23 associated with the frame 15.

In this way, the lid 5 guarantees a complete and stable closure when shut, whereas when the lid 5 is in the open position, the packet 2 appears from the front as a conventional rigid packet, or at least devoid of any peculiarities that might be seen as impairing it aesthetically.

Figure 4:
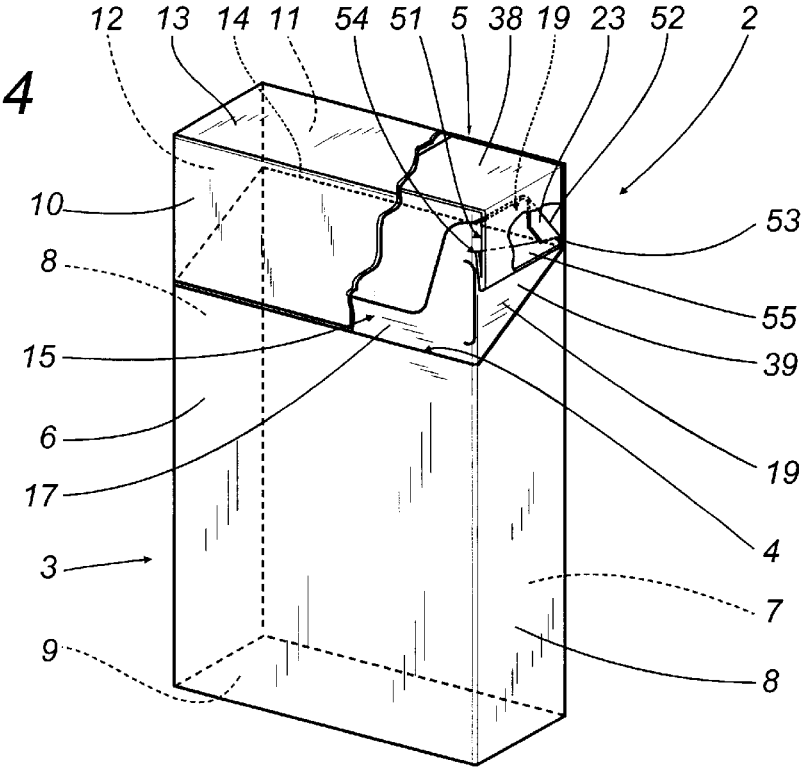
FIG. 4 illustrates a further embodiment of the packet according to the present invention.
Figure 5:
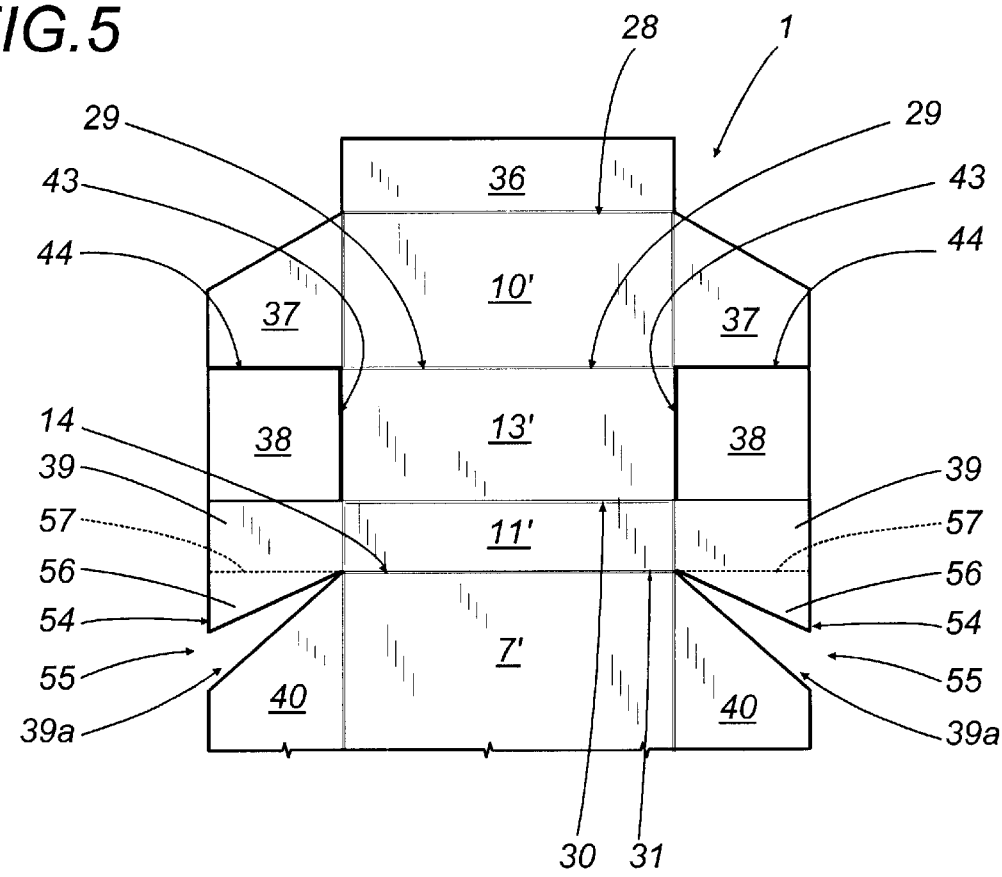
FIG. 5 and FIG. 6 are plan views respectively of a diecut blank, illustrated in part, and an inner reinforcing frame, used in the packet of FIG. 4.
Figure 6:
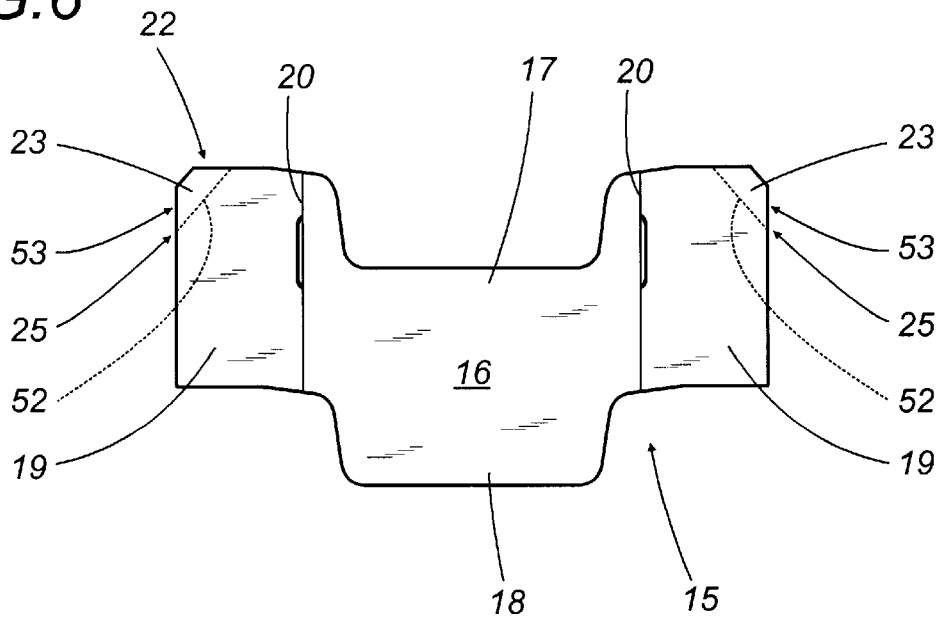

In the example of FIGS. 4, 5 and 6 the frame 15 is fashioned with flaps 23 of substantially triangular geometry each coinciding with a corner portion 25 of the upper portion 22 afforded by the relative lateral panel 19, which is bent double along an oblique crease line 52 and effectively flattened against the panel 19 (in conventional manner, not illustrated) to assume a Vee section; the corner portion 25 presents an edge 53 designed to engage the edge 54 offered by a corresponding flap 55 of substantially triangular appearance associated with the lid 5, in this instance an angular portion 56 of the stiffening fold 51 bent double toward the inside of the container 3 (in conventional manner, not illustrated) along a relative transverse crease line 57.

What is claimed:

1. A rigid packet with a hinged lid for elongated elements, comprising a cupped container that presents a front face and a rear face mutually opposed and parallel, two parallel flank faces perpendicular to the front and rear faces, an end face orthogonal to the front, rear and flank faces, and one open end; a lid hinged to the container and capable thus of movement relative to the container away from and toward a position in which it functions as a closure for the open end, presenting a front face and a rear face mutually opposed and parallel, two parallel flank faces perpendicular to the front and rear faces, and an end face orthogonal to the front, rear and flank faces; a reinforcing frame of "U" outline inserted partly into the container and breasted in contact with the front face and two flank faces thereof, presenting a front portion and two lateral portions projecting from the open end; also mutual retaining means afforded by the frame and the lid, such as will cause the lid to snap shut, wherein the mutual retaining means comprise two flaps bent substantially double to assume a Vee section, each associated with a relative projecting lateral portion of the reinforcing frame, and two flaps located internally of the lid, each associated with a relative flank face, positioned such that each bent flap engages a corresponding flap of the lid when in the closed position.

2. A packet as in claim 1, wherein each bent flap coincides with a free extremity of the projecting lateral portion that is bent double along a crease line and effectively flattened against the selfsame portion to assume a Vee section.

3. A packet as in claim 1, wherein each flap of the lid establishes an internal fold serving to stiffen the relative flank face of the lid and presenting a substantially rectangular notch of which one edge is positioned to snap into engagement with a corresponding edge of the bent flap associated with the frame.

4. A packet as in claim 2, wherein each flap of the lid establishes an internal fold serving to stiffen the relative flank face of the lid and presenting a substantially rectangular notch of which one edge is positioned to snap into engagement with a corresponding edge of the bent flap associated with the frame.

5. A packet as in claim 1, wherein each bent flap coincides with a corner portion of the projecting lateral portion that is bent double along an oblique crease line and effectively flattened against the selfsame portion to assume a Vee section.

6. A packet as in claim 5, wherein each flap of the lid consists in an angular portion of an internal fold serving to stiffen the relative flank face of the lid, which is bent double along a crease line to assume a Vee section and presents an edge positioned to snap into engagement with a corresponding edge of the bent flap associated with the frame.

* * * * *